United States Patent [19]

O'Hara et al.

[11] 4,396,921

[45] Aug. 2, 1983

[54] MATCHING SECTION FOR MULTI-ARM SPIRAL ANTENNA

[75] Inventors: Francis J. O'Hara, Bedford; John F. Toth, Reading; Jerold L. Weiss, Wayland; Armand R. Chinchillo, Saugus, all of Mass.

[73] Assignee: Raytheon Company, Lexington, Mass.

[21] Appl. No.: 316,458

[22] Filed: Oct. 30, 1981

[51] Int. Cl.[3] ..... H01Q 3/26

[52] U.S. Cl. ..... 343/895; 333/34

[58] Field of Search ..... 343/895, 822, 850, 860, 343/861; 333/33, 34

[56] References Cited

U.S. PATENT DOCUMENTS 2,934,719 4/1960 Kyhl ..... 333/34

3,518,691 6/1970 Hallendorff ..... 333/34

3,555,554 1/1971 Shu Kuo ..... 343/895

4,143,380 3/1979 Kyle ..... 343/895

*Primary Examiner*—David K. Moore

*Attorney, Agent, or Firm*—Philip J. McFarland; Joseph D. Pannone

[57] ABSTRACT

A matching section for a spiral antenna used in a monopulse receiver is shown to receive a plurality of coaxial cables at equally spaced points along the circumference of a first circle and to guide the center conductors of such cables to arms of a multi-arm spiral antenna at equally spaced points along the circumference of a second circle, the characteristic impedance along the length of the matching section changing smoothly for the sum and difference modes and impedance matching closely to the antenna sum and difference modes.

2 Claims, 1 Drawing Figure

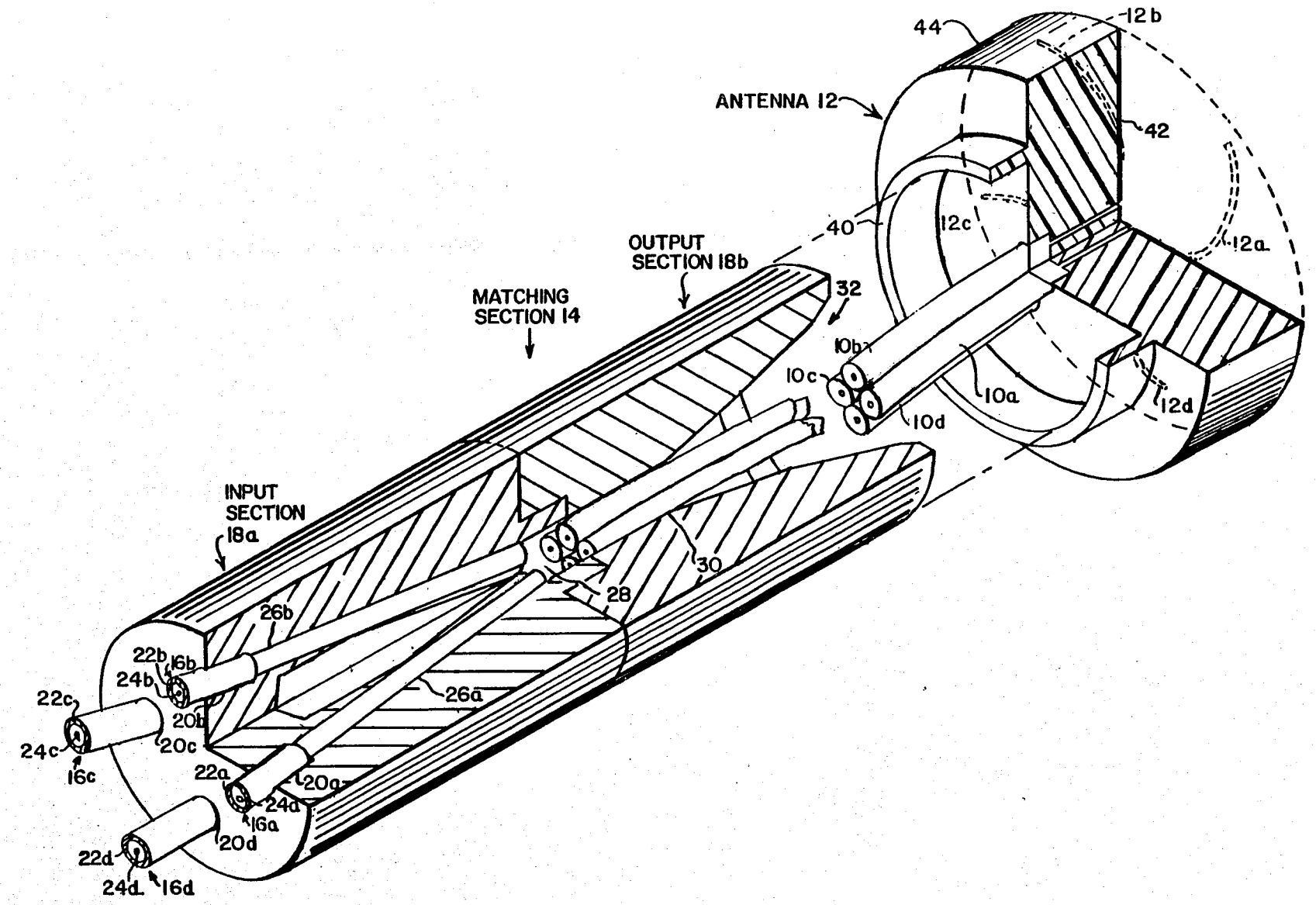
ANTENNA 12
12a
12b
12c
12d
42
44
40
32
10a
10b
10c
10d
OUTPUT SECTION 18b
MATCHING SECTION 14
INPUT SECTION 18a
30
28
26a
26b
20a
20b
20c
20d
22a
22b
22c
22d
24a
24b
24c
24d
16a
16b
16c
16d

MATCHING SECTION FOR MULTI-ARM SPIRAL ANTENNA

BACKGROUND OF THE INVENTION

This invention pertains generally to broadband circularly polarized spiral antennas and particularly to an improved feed for such type of antennas.

As is known in the art, a multi-arm spiral antenna is used to advantage in a direction finder system because such an antenna can encode the location of a radiation emitter in information contained in its sum and difference beams and is circularly polarized and relatively broadband. A typical spiral antenna for such an application is a four-arm device, with each one of the arms fed by a separate wire of a four-wire balanced transmission line. Theoretically, a relatively good impedance match over the desired bandwidth may be maintained between the antenna elements and the associated four-wire feed for any possible radiating mode of the antenna. When a monopulse arithmetic network is used to develop sum and difference mode direction-finding signals such a network usually is a transverse electro-magnetic (TEM) mode device as might be fabricated in stripline so that an interface is required between the four-wire feed for the radiating arms of the antenna and the monopulse arithmetic network. Unfortunately, when a four coaxial line to four-wire transmission line transition is required, the characteristic impedances of the two kinds of transmission line differ substantially and impedance mismatch causes a large reflection so the usefulness of the resulting systems is impaired by this contribution to direction finder angle measurement error.

One conventional technique for realizing the requisite transition is to form a junction between the four coaxial cables from the monopulse arithmetic network and the spiral antenna after stripping away a portion of the outer conductors of each one of the four coaxial cables so that the free ends of each such cable together form a four-wire transmission line. The outer conductors of each one of the coaxial cables are soldered into a restraining yoke located near the junction of the four-wire feed to the spiral antenna radiating arms and the free ends of the four-wire line formed by the center conductors are soldered to arms of the spiral antenna to connect each arm to the monopulse arithmetic network. Unfortunately, however, a transition so formed exhibits a relatively high voltage standing wave ratio (VSWR) over the entire operating bandwidth for both the sum and difference radiating modes of the antenna actually used. As a result, then, phase and amplitude errors are introduced in the operation of a direction-finder antenna system using such a known transition.

SUMMARY OF THE INVENTION

With this background of the invention in mind, it is, therefore, an object of this invention to provide a broadband transition for both sum and difference modes from four coaxial cables to a four-wire feed having an improved impedance match over a wide operating band.

The foregoing and other objects of this invention are generally attained by providing a tapered impedance transition from the impedance exhibited by each one of the four coaxial cables to the impedance at the terminal of each feed in a four-wire feed.

BRIEF DESCRIPTION OF THE DRAWING

This and other objects and many of the attendant advantages of this invention will be readily appreciated as the same becomes better understood by reference to the following detailed description when considered in connection with the accompanying drawing wherein the single FIGURE is an isometric view, partially cut away, illustrating a matching section according to the concepts of this invention.

DESCRIPTION OF THE PREFERRED EMBODIMENT

Referring now to the single FIGURE, it may be seen that the individual feed wires 10*a*, 10*b*, 10*c*, 10*d* for the antenna elements 12*a*, 12*b*, 12*c*, 12*d* of a multi-arm spiral antenna 12 are, in accordance with this invention, passed through a matching section 14, to be described. Suffice it to say here that the construction of the matching section 14 is such that there is a smooth transition in impedance along the length of the feed wires 10*a*, 10*b*, 10*c*, 10*d* between the relatively low impedance of each coaxial cable 16*a*, 16*b*, 16*c*, 16*d* and the relatively high impedance of a corresponding antenna element 12*a*, 12*b*, 12*c*, 12*d* for all transmission line modes corresponding to the orthonormal set which the antenna can radiate. Further, because the smoothness of the impedance transformation in the matching section 14 is the result of its construction, such smoothness is maintained over a broad band of operating frequencies and in any monopulse mode of operation.

Here, for ease of machining, the matching section 14 is fabricated from two separate metallic cylindrical rods (arbitrarily designated input section 18*a* and output section 18*b*). Although any of the metals or alloys used in microwave applications may be used, it is preferred that the material here be aluminum. After machining, the two just-mentioned sections are aligned as shown and locked together in any convenient manner to form the matching section 14 through which the feed wires 10*a*, 10*b*, 10*c*, 10*d* are passed. Here the locking of the input section 18*a* with the output section 18*b* is accomplished by screws (not numbered) in a conventional manner.

A number (here 4) of countersunk holes 20*a*, 20*b*, 20*c*, 20*d* are machined in the open end of input section 18*a*, each such hole being dimensioned to receive the outer conductor 22*a*, 22*b*, 22*c*, 22*d* of one of the coaxial cables 16*a*, 16*b*, 16*c*, 16*d*. Before insertion, each one of such cables is prepared by stripping away a portion of its outer conductor so that a length of each inner conductor 24*a*, 24*b*, 24*c*, 24*d* (and the dielectric, not numbered) is exposed. Such length is such that the inner conductor 24*a*, 24*b*, 24*c*, 24*d* may be passed through the matching section 14 from the bottom of a countersunk hole 20*a*, 20*b*, 20*c*, 20*d* to a connection point (not numbered) on each antenna element 12*a*, 12*b*, 12*c*, 12*d* of the multi-arm spiral antenna 12. Round holes (26*a*, 26*b*, being shown) are formed as shown, each with one end opening on the bottom of a countersunk hole 20*a*, 20*b*, 20*c*, 20*d* and a fairing so that the four channels 26*a*, 26*b*, 26*c*, 26*d* merge together gradually along the sides of a single cylindrical channel 28. The longitudinal axis of the just mentioned channel is coincident with the longitudinal axis of the input section 18*a* and the diameter of such channel is approximately equal to $r(1+\sqrt{2})$, where "r" equals the radius of the stripped portion of the coaxial cables 16*a*, 16*b*, 16*c*, 16*d*.

The output section 18*b* is shaped as shown to form a piecewise or smoothly tapered horn 32 where the throat 30 is a cylindrical shape matching the cylindrical channel 28. The taper in the horn 32 (and the fairing of the round channels 26*a*, 26*b*, 26*c*, 26*d* into the central counterbore) are proportioned in a known manner so that the surface of the horn 32 (and the round channels 26*a*, 26*b*, 26*c*, 26*d*) appears to be an electrically smooth surface over the band of operating frequencies of the multi-arm spiral antenna 12 resulting in the desired well matched tapered impedance transformation along the matching section.

It will now be apparent that the prepared coaxial lines 16*a*, 16*b*, 16*c*, 16*d* may be assembled with the just-described matching section 14 so that the free ends (not numbered) of the outer conductors 22*a*, 22*b*, 22*c*, 22*d* bottom on the countersunk holes 20*a*, 20*b*, 20*c*, 20*d* and the inner conductors 24*a*, 24*b*, 24*c*, 24*d* are passed through the matching section 14. The outer conductors 22*a*, 22*b*, 22*c*, 22*d* are joined to the input section, in any convenient manner, by soldering or conductive cement.

The multi-arm spiral antenna 12 (shown partly in phantom) is supported by the same structure (not shown) which supports the feed matching section. It consists of a dielectric disc 42 carrying the spiral radiating arms 12*a*, 12*b*, 12*c*, 12*d* (typically photolithographically etched from metal foil). The feed points of the antenna arms 12*a*, 12*b*, 12*c*, 12*d* are coincident with the free ends of the four-wire transmission line. Feed holes are formed through the dielectric disc 42 so that the feed lines which extend through the absorber 44 pass to the inner ends of the spiral arms 12*a*, 12*b*, 12*c*, 12*d* to which they are connected, as by soldering. The feed holes (not numbered) are located at equally spaced points around the circumference of a circle (the feed circle) about the longitudinal centerline of the matching section 14 (when assembled with the complete multi-arm spiral antenna 12). The feed circle diameter is calculated in a known manner so that the characteristic impedances of the four-wire transmission line at the antenna interface match closely the antenna sum and difference mode impedances. (Alternatively, the feed wire diameters may be chosen to secure the same interface impedance levels for a determined antenna feed circle diameter since the highest antenna operating frequency constrains the allowable feed circle diameter.) Sum and difference mode input impedances for a self-complementary aperture four-arm equiangular spiral antenna are 133 ohms and 94 ohms, respectively. Calculations show the corresponding feed mode impedance for the structure described to be 125 ohms and 97 ohms, respectively, providing a good match to both modes. Time domain reflectometer measurements transformed to the frequency domain for a single feed line V shows the VSWR (averaged over all four possible transmission line modes) to be under 1.25:1 over more than 1-½ octaves.

Having illustrated and described the preferred embodiment of this invention, it will now be apparent that changes may be made without departing from the inventive concepts. Specifically, the dimensions and shape of the contemplated matching section may be changed so long as the concept of having a smooth transition in impedance between coaxial cables and a four-wire line is maintained. It is felt, therefore, that this invention should not be restricted to its disclosed embodiment, but rather should be limited only by the spirit and scope of the appended claims.

What is claimed is:

1. In a monopulse receiver utilizing a spiral antenna having four arms separately connected to a monopulse arithmetic unit through the center conductors of four coaxial cables and insulated extensions of such conductors, an impedance matching section disposed adjacent to the spiral antenna and overlaying the insulated extensions of the center conductors, such section comprising a metallic cylinder with a channel formed longitudinally thereof, such channel having:

(a) a central section dimensioned to accommodate the insulated extensions;

(b) a first end section, proximal to the spiral antenna, with a generally conical shape faired into the central section; and (c) a second end section, distal from the spiral antenna, with a quadri-furcate shape faired into the central section and dimensioned to accommodate the outer conductors of the coaxial cables.

2. A broadband multimode transition for converting the impedance of a plurality of coaxial cables to that of a like plurality of wire feeds formed by stripping away portions of the outer conductors of the coaxial cables, each transition comprising an input section having a plurality of angled holes provided in one end thereof for accepting those portions of the coaxial cables from which the outer conductors have been removed, a common central cavity wherein the cables are combined into a symmetrical bundle, and an output section wherein the wall of the cavity is tapered away from the cables.

* * * * *